US011346369B2

(12) United States Patent
Logsdon et al.

(10) Patent No.: US 11,346,369 B2
(45) Date of Patent: May 31, 2022

(54) BLOWER ASSEMBLY AND METHODS OF ASSEMBLING THE SAME

(71) Applicant: REGAL BELOIT AMERICA, INC., Beloit, WI (US)

(72) Inventors: Michael A. Logsdon, Wausau, WI (US); Jason Jon Kreidler, Sheboygan, WI (US); Wesley Kenneth Anderson, Cedarburg, WI (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 483 days.

(21) Appl. No.: 16/168,030

(22) Filed: Oct. 23, 2018

(65) Prior Publication Data

US 2019/0120251 A1 Apr. 25, 2019

Related U.S. Application Data

(60) Provisional application No. 62/575,794, filed on Oct. 23, 2017.

(51) Int. Cl.

| | |
|---|---|
| ***F04D 29/62*** | (2006.01) |
| ***F04D 29/64*** | (2006.01) |
| ***F04D 25/06*** | (2006.01) |
| ***F04D 25/12*** | (2006.01) |
| ***F04D 29/42*** | (2006.01) |
| ***F04D 13/06*** | (2006.01) |
| ***F04D 17/16*** | (2006.01) |

(Continued)

(52) U.S. Cl.

CPC ..... *F04D 29/644* (2013.01); *F04D 13/0646* (2013.01); *F04D 17/16* (2013.01); *F04D 19/002* (2013.01); *F04D 25/06* (2013.01); *F04D 25/0606* (2013.01); *F04D 25/0653* (2013.01); *F04D 25/12* (2013.01); *F04D 29/4226* (2013.01); *F04D 29/522* (2013.01)

(58) Field of Classification Search

None

See application file for complete search history.

(56) References Cited

U.S. PATENT DOCUMENTS 4,687,908 A * 8/1987 Thorne ..... F24C 15/322 126/21 A
5,547,350 A * 8/1996 Rawal ..... F04D 25/0606 417/354

(Continued)

FOREIGN PATENT DOCUMENTS

CN 202789761 U 3/2013
CN 103052806 A 4/2013

(Continued)

OTHER PUBLICATIONS

English Translation of First Office Action for Chinese Patent Application No. 20018112359615 dated Apr. 2, 2021; 18 pp.

*Primary Examiner* — Kayla McCaffrey
(74) *Attorney, Agent, or Firm* — Armstrong Teasdale LLP

(57) ABSTRACT

A blower assembly includes a fan including a front plate that defines a fan inlet. The blower assembly also includes an inlet plate positioned adjacent the fan such that the inlet plate and the front plate define a cavity therebetween that extends circumferentially about the fan inlet. A motor is coupled to the fan and to the inlet plate and configured to rotate about the rotational axis. The motor is positioned within the cavity.

20 Claims, 3 Drawing Sheets

(51) Int. Cl.
*F04D 19/00* (2006.01)
*F04D 29/52* (2006.01)

(56) References Cited

U.S. PATENT DOCUMENTS

| | | | | |
|---|---|---|---|---|
| 6,386,839 | B1 * | 5/2002 | Chuang | F01D 5/045 415/199.6 |
| 7,887,289 | B2 * | 2/2011 | Tokunaga | F04D 25/0606 415/206 |
| 9,157,441 | B2 | 10/2015 | Dickinson et al. | |
| 9,574,568 | B2 | 2/2017 | Dickinson et al. | |
| 2011/0011203 | A1 | 1/2011 | Yamamoto et al. | |
| 2012/0169154 | A1 | 7/2012 | Curodeau | |

FOREIGN PATENT DOCUMENTS

| | | | |
|---|---|---|---|
| CN | 105814777 | A | 7/2016 |
| CN | 107061354 | A | 8/2017 |
| EP | 1335479 | A2 | 8/2003 |

* cited by examiner

BLOWER ASSEMBLY AND METHODS OF ASSEMBLING THE SAME

BACKGROUND OF THE INVENTION

The embodiments described herein relate generally to blower assemblies, and more particularly, to blower assemblies for use in forced air or air circulating systems.

Many known residential and commercial forced air, heating and air conditioning distribution systems require air propulsion units. In addition to providing movement of air for heating and cooling systems, air propulsion units are often used in combination with condenser units or to supplement other heat transfer operations. Some known air propulsion units are motor driven fans. These fans may be, for example, a plenum wheel driven by an electric motor.

Blower assemblies are known to be used to pressurize a rectangular cabinet with air for channeling to other components of the air distribution system. At least some known blower assemblies include a plenum wheel that is rotated by a motor. In at least one known blower assembly, the motor is mounted to a rear plate of the plenum wheel and extends in a direction away from an inlet of the plenum wheel. At least some known motors are large and require an elaborate support structure that occupies valuable space within the air distribution system. Additionally, the support structure itself increases the overall weight of the blower assembly, which may be undesirable.

At least some known blower assemblies include low-profile motors that do not require the robust support structure of other known blower assemblies. However, such low-profile motors still extend from the rear plate of the plenum wheel and require at least some support structure to support the motor

BRIEF DESCRIPTION OF THE INVENTION

In one aspect, a blower assembly is provided. The blower assembly includes a fan including a front plate that defines a fan inlet. The blower assembly also includes an inlet plate positioned adjacent the fan such that the inlet plate and the front plate define a cavity therebetween that extends circumferentially about the fan inlet. A motor is coupled to the fan and to the inlet plate and configured to rotate about the rotational axis. The motor is positioned within the cavity.

In another aspect, a method of assembling a blower assembly is provided. The method includes defining a fan inlet in a front plate of a fan configured to rotate about the rotational axis and positioning an inlet plate adjacent the front plate such that the inlet plate and the front plate define a cavity therebetween that extends circumferentially about the fan inlet. The method also includes coupling a motor to the fan and to the inlet plate such that the motor is positioned within the cavity.

DETAILED DESCRIPTION OF THE INVENTION

The present disclosure provides an exemplary blower assembly that includes a large diameter motor positioned in a cavity defined by a front plate of a fan and an inlet plate of a blower housing. The motor extends circumferentially within the cavity such that the motor is axially aligned with and circumscribes the air inlet of the blower assembly. As such, the motor is axially spaced from, that is, not coupled to, the rear plate of the fan. In such a configuration, the blower assembly described herein does not include physical structure coupled to and extending from the rear plate of the fan in a direction away from the fan inlet. Because the motor is supported by the fan and the inlet plate, the blower assembly described herein does not require the elaborate support structure included in at least some known blower assemblies. Accordingly, positioning the motor at the inlet end of the fan in the blower assembly described herein reduces the physical space occupied by the blower assembly inside an air distribution system, decreases the overall weight of the blower assembly due to a reduced or removed support structure, and reduces the overall cost of the blower assembly.

Figure 1:
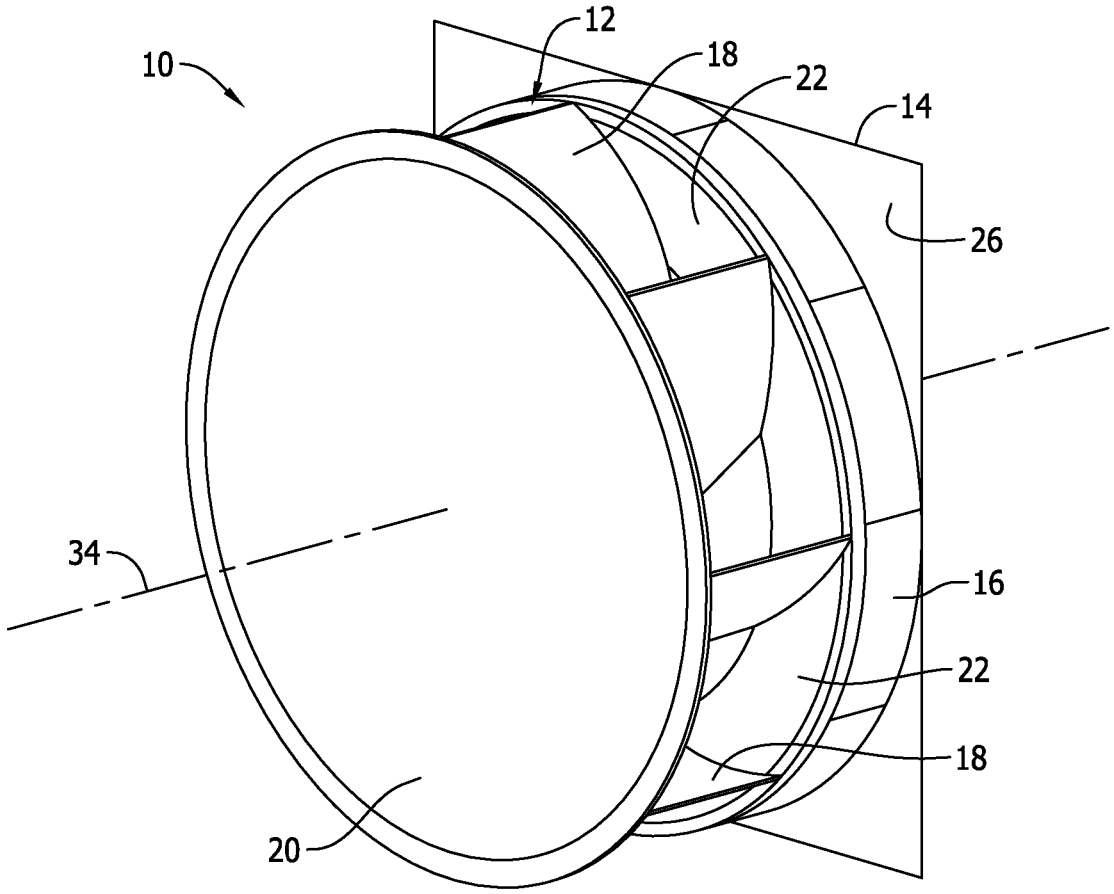
FIG. 1 is a rear perspective view of an exemplary blower assembly.
Figure 2:
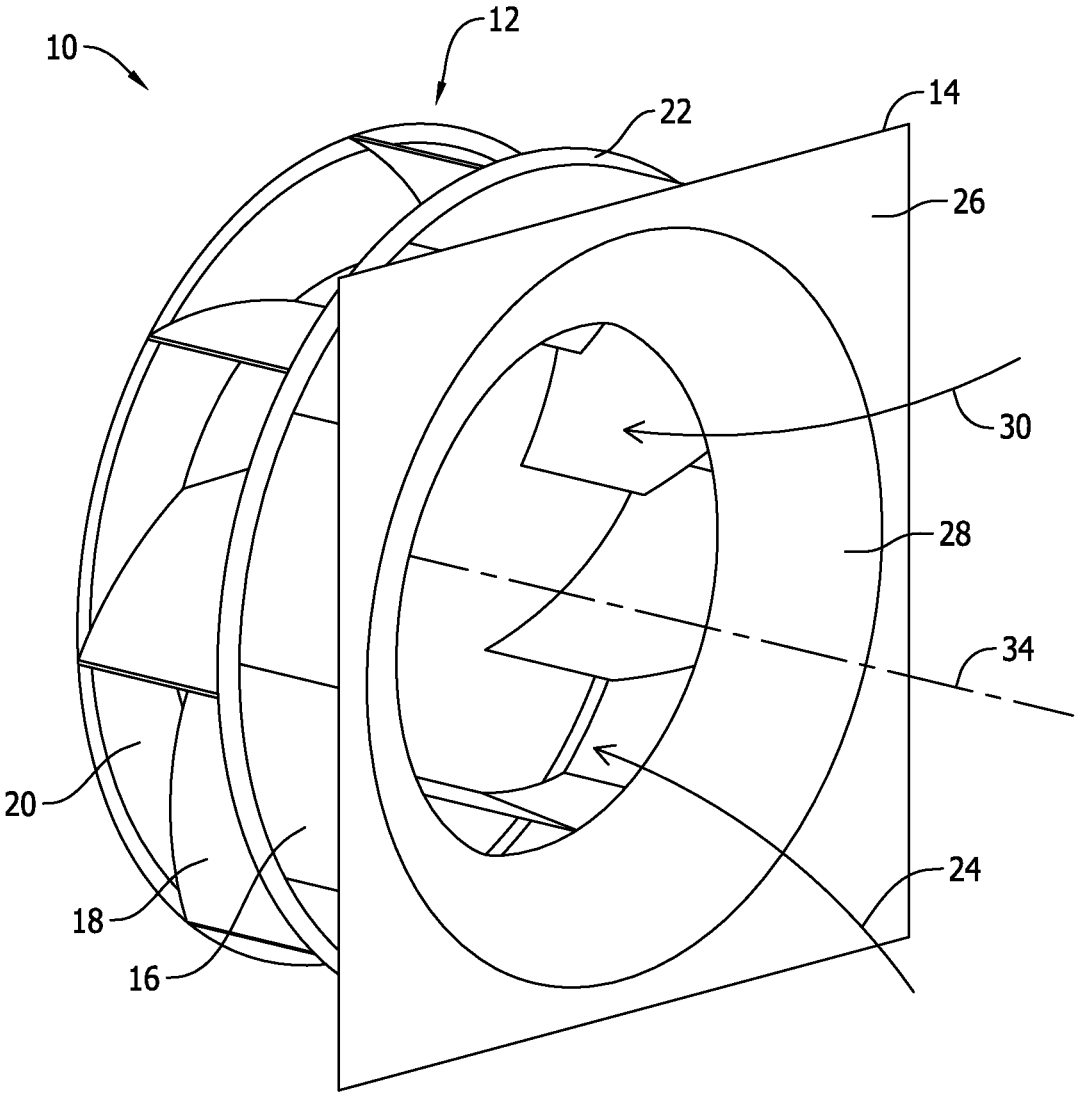
FIG. 2 is a front perspective view of the blower assembly shown in FIG. 1.
Figure 4:
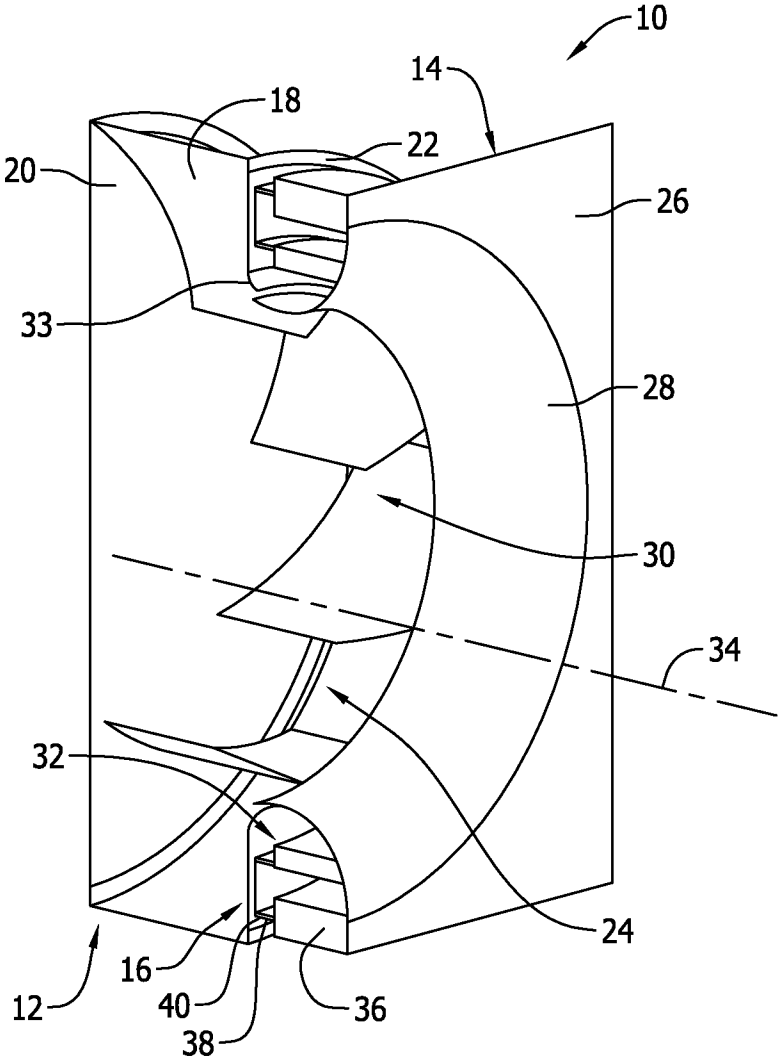
FIG. 4 is a front cross-sectional perspective view of the blower assembly shown in FIG. 1 illustrating the plenum wheel, the inlet ring, and the motor.
Figure 3:
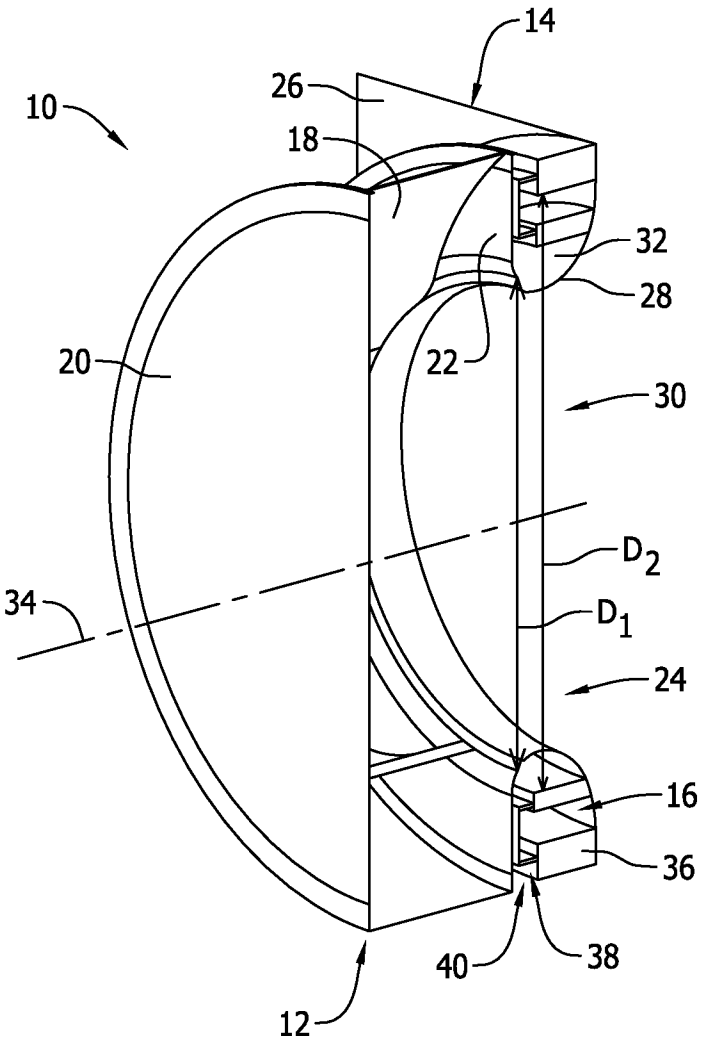
FIG. 3 is a rear cross-sectional perspective view of the blower assembly shown in FIG. 1 illustrating a plenum wheel, an inlet ring, and a motor.

FIG. 1 is a rear perspective view of a blower assembly 10, and FIG. 2 is a front perspective view of blower assembly 10. FIG. 3 is a rear cross-sectional perspective view of blower assembly 10 illustrating a fan 12, an inlet plate 14, and a motor 16, and FIG. 4 is a front cross-sectional perspective view of blower assembly 10 illustrating fan 12, inlet plate 14, and motor 16. In the exemplary embodiment, blower assembly 10 is configured to produce a flow of air for a forced air system, e.g., a residential HVAC system. Blower assembly 10 includes fan 12 having a plurality of blades 18 coupled between a back plate 20 and front plate 22. Front plate 22 includes a fan inlet 24 through which air enters fan 12. In the exemplary embodiment, fan 12 includes eight backward inclined blades 18. Alternatively, blades 18 may have any suitable blade shape and orientation, for example airfoil-shaped blades, backward curved blades, forward curved blades, forward inclined blades, or radial blades that enables blower assembly 10 to operate as described herein. Furthermore, blower assembly 10 may include any number of blades 18 that enable operation as described herein. Although described herein as a blower assembly including fan 12, blower assembly 10 may include any type of fan, impeller, or wheel that facilitates operation of blower assembly as described herein.

In the exemplary embodiment, inlet plate 14 includes a plate portion 26 and an inlet ring 28. Inlet ring 28 defines a plate inlet 30 that is aligned with fan inlet 24 along a rotation axis 34 of fan 12 and motor 16. Inlet plate 14 is positioned adjacent fan 12 such that inlet plate 14 and front plate 22 of fan 12 combine to define a cavity 32 therebetween. As best shown in FIGS. 3 and 4, cavity 32 extends circumferentially around fan inlet 24. Front plate 22 includes a flange 33 that extends outward to at least partially overlap with inlet ring 28 such that cavity 32 is separated from inlets 24 and 30 by flange 33 and inlet ring 28. More specifically, front plate 22, flange 33, and inlet ring 28 combine to define cavity 32 as a substantially U-shaped cavity.

In the exemplary embodiment, motor 16 is an axial flux motor and is coupled to both fan 12 and to inlet plate 14 and is positioned within cavity 32. Alternatively, motor 16 may be a radial flux motor. Generally, motor 16 includes any motor type that facilitates operation of blower assembly 10 as described herein.

Motor 16 includes a stator 36, a rotor 38 and a bearing assembly 40 that are all coupled within cavity 32. Specifically, stator 36 is coupled to one or both of inlet ring 28 and plate portion 26, and rotor is coupled to front plate 22 of fan 12. More specifically, rotor 38 is directly coupled to front plate 22 such that rotation of rotor about axis 34 causes rotation of front plate 22, and fan 12, about axis 34. Bearing assembly 40 includes a stationary race (not shown) coupled to inlet plate 14 and a rotating race (not shown) coupled to front plate 22. As such, components of bearing assembly 40 are coupled to both inlet plate 14 and to front plate 22.

As best shown in FIGS. 3 and 4, extends circumferentially within cavity 32 about fan inlet 24 and plate inlet 30. More specifically, fan inlet 24 includes a first inner diameter D1 and motor 16 includes a second inner diameter D2 that is larger than first inner diameter D1. As such, motor 16 circumscribes both fan inlet 24 and plate inlet 30 such that air entering fan 12 first passes through the central opening (not shown) of motor 16 before being turned by blades 18 of fan 12. More specifically, motor 16 is axially aligned with fan inlet 24 and plate inlet 30.

In operation, motor 16 is electrified to cause rotation of rotor 38, which causes rotation of fan 12 about axis 34. As fan 12 rotates, blades 18 pull air into fan 12 through inlets 24 and 30. The air is deflected outward from axis 34 towards blades 18 and ejected radially outward through an outlet defined between adjacent blades 18 due to the centrifugal force generated by rotating blades 18. Outlet 22 is defined as a diverging gap between adjacent blades 12.

The present disclosure provides an exemplary blower assembly that includes a large diameter motor positioned in a cavity defined by a front plate of a fan and an inlet plate of a blower housing. The motor extends circumferentially within the cavity such that the motor is axially aligned with and circumscribes the air inlet of the blower assembly. As such, the motor is axially spaced from, that is, not coupled to, the rear plate of the fan. In such a configuration, the blower assembly described herein does not include physical structure coupled to and extending from the rear plate of the fan in a direction away from the fan inlet. Because the motor is supported by the fan and the inlet plate, the blower assembly described herein does not require the elaborate support structure included in at least some known blower assemblies. Accordingly, positioning the motor at the inlet end of the fan in the blower assembly described herein reduces the physical space occupied by the blower assembly inside an air distribution system, decreases the overall weight of the blower assembly due to a reduced or removed support structure, and reduces the overall cost of the blower assembly.

The embodiments described herein relate to a blower assembly and methods of assembling the same. More specifically, the embodiments relate to a blower assembly that includes blower assembly that includes a large diameter motor positioned in a cavity defined by a front plate of a fan and an inlet plate of a blower housing. The motor extends circumferentially within the cavity such that the motor is axially aligned with and circumscribes the air inlet of the blower assembly. The methods and apparatus are not limited to the specific embodiments described herein, but rather, components of apparatus and/or steps of the methods may be utilized independently and separately from other components and/or steps described herein. For example, the methods may also be used in combination with a forward inclined fan or blower assembly or a radial flux electric motor, and are not limited to practice with only the backward curved fan and axial flux motor as described herein. In addition, the exemplary embodiment can be implemented and utilized in connection with many other HVAC applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blower assembly comprising a rotational axis, said blower assembly comprising:

a fan comprising a front plate that defines a fan inlet;

an inlet plate positioned adjacent said fan such that said inlet plate and said front plate define a cavity therebetween that extends circumferentially about said fan inlet; and a motor coupled to said fan and to said inlet plate and configured to rotate about the rotational axis, wherein the motor comprises a rotor and a stator, wherein said motor is positioned within said cavity, wherein said front plate extends radially beyond said stator and said rotor.

2. The blower assembly in accordance with claim 1, wherein said inlet plate comprises an inlet ring and a plate portion, wherein said inlet ring defines a plate inlet aligned with said fan inlet, and wherein said inlet ring extends axially beyond said motor.

3. The blower assembly in accordance with claim 2, wherein said motor extends circumferentially about said fan inlet and said plate inlet.

4. The blower assembly in accordance with claim 2, wherein said front plate and said inlet ring combine to define said cavity as a U-shaped cavity.

5. The blower assembly in accordance with claim 1, wherein said rotor is coupled to said front plate and said stator is coupled to said inlet plate.

6. The blower assembly in accordance with claim 5, wherein said motor comprises a bearing assembly coupled to said front plate and to said inlet plate.

7. The blower assembly in accordance with claim 5, wherein said rotor is coupled directly to said front plate.

8. The blower assembly in accordance with claim 1, wherein said motor extends about a circumference of said fan inlet.

9. The blower assembly in accordance with claim 1, wherein said motor is axially aligned with said fan inlet.

10. The blower assembly in accordance with claim 1, wherein said fan inlet of said front plate includes an inner diameter, and wherein said motor includes an inner diameter that is larger than said fan inlet inner diameter.

11. A method of assembling a blower assembly that includes a rotational axis, said method comprising:

defining a fan inlet in a front plate of a fan configured to rotate about the rotational axis;

positioning an inlet plate adjacent the front plate such that the inlet plate and the front plate define a cavity therebetween that extends circumferentially about the fan inlet;

coupling a motor to the fan and to the inlet plate such that the motor is positioned within the cavity, wherein the motor includes a rotor and a stator, wherein the front plate extends radially beyond the motor; and coupling a bearing assembly to the rotor such that the bearing assembly is at least partially positioned radially outward of the rotor.

12. The method in accordance with claim 11, wherein positioning the inlet plate comprises aligning a housing inlet defined by an inlet ring of the inlet plate with the fan inlet.

13. The method in accordance with claim 12, wherein coupling the motor to the fan and to the inlet plate comprises coupling the motor to the fan and to the inlet plate such that the motor extends circumferentially about the fan inlet and the housing inlet.

14. The method in accordance with claim 12, wherein positioning the inlet plate comprises positioning the inlet plate such that the front plate and the inlet ring combine to define the cavity as a U-shaped cavity.

15. The method in accordance with claim 11, wherein coupling the motor to the fan and to the inlet plate comprises coupling the rotor of the motor to the front plate and coupling the stator of the motor to the inlet plate.

16. The method in accordance with claim 15, wherein coupling the motor to the fan and to the inlet plate comprises coupling the bearing assembly of the motor to the fan and to the inlet plate.

17. The method in accordance with claim 15, wherein coupling the motor to the fan and to the inlet plate comprises coupling the rotor directly to the front plate.

18. The method in accordance with claim 11, wherein coupling the motor to the fan and to the inlet plate comprises coupling the motor such that the motor extends about a circumference of the fan inlet.

19. The method in accordance with claim 18, wherein coupling the motor to the fan and to the inlet plate comprises coupling the motor such that the motor extends about a complete circumference of the fan inlet.

20. The method in accordance with claim 11, wherein coupling the motor to the fan and to the inlet plate comprises coupling the motor such that the motor is axially aligned with the fan inlet.

* * * * *